US012747579B2

(12) United States Patent
Jiang et al.

(10) Patent No.: US 12,747,579 B2
(45) Date of Patent: Sep. 29, 2026

(54) OPTIMIZED WALL STRUCTURE OF A PREFAB MODULAR SHED

(71) Applicant: YIXIANG BLOW MOLDING FURNITURE CO., LTD., Yuyao (CN)

(72) Inventors: Yixiang Jiang, Yuyao (CN); Jinglei Jiang, Yuyao (CN); Shangxi Jiang, Yuyao (CN)

(73) Assignee: YIXIANG BLOW MOLDING FURNITURE CO., LTD., Yuyao (CN)

( * ) Notice: Subject to any disclaimer, the term of this patent is extended or adjusted under 35 U.S.C. 154(b) by 148 days.

(21) Appl. No.: 18/912,494

(22) Filed: Oct. 10, 2024

(65) Prior Publication Data

US 2025/0333951 A1 Oct. 30, 2025

(30) Foreign Application Priority Data

Apr. 25, 2024 (CN) ..... 202420876192.1

(51) Int. Cl.
*E04B 1/343* (2006.01)
*E04B 1/348* (2006.01)
*E04H 1/12* (2006.01)

(52) U.S. Cl.
CPC ..... *E04B 1/34321* (2013.01); *E04B 1/34846* (2013.01); *E04H 1/1205* (2013.01)

(58) Field of Classification Search
CPC ..... E04B 1/34321; E04B 1/34317; E04B 1/34384; E04B 1/6116; E04B 1/6137; E04B 1/6162; E04B 2001/6195; E04B 2103/04; E04B 1/12; E04B 1/6141; E04B 1/34846; E04H 1/1205; E04H 1/005
See application file for complete search history.

(56) References Cited

U.S. PATENT DOCUMENTS 3,702,522 A * 11/1972 Adams ..... E04B 2/7435 52/775
3,731,449 A * 5/1973 Kephart, Jr. ..... B32B 27/065 52/309.7
3,975,878 A * 8/1976 Modarelli, Jr. ..... E04B 1/6179 52/393
5,357,728 A * 10/1994 Duncanson ..... E04C 2/526 52/592.4
7,377,077 B2 * 5/2008 Rebeck ..... E04H 1/1205 52/DIG. 14
7,685,676 B2 * 3/2010 Mc Clellan ..... E05D 1/02 16/221
7,770,334 B2 * 8/2010 Mower ..... E04H 1/1205 52/79.6

(Continued)

*Primary Examiner* — Rodney Mintz
(74) *Attorney, Agent, or Firm* — Platinum Intellectual Property PC

(57) ABSTRACT

The present subject matter discloses an improved wall structure for a modular plastic shed, designed for easy on-site assembly using pre-constructed modular panels. The enhanced wall structure features T-shaped connection accessories that securely install the wall to the floor panels. Additionally, support columns with integrated reinforcement ribs are incorporated to further strengthen the overall structure. These support columns also feature pre-formed sockets, allowing for quick and straightforward attachment of the wall panels, simplifying the assembly process and improving structural integrity.

17 Claims, 8 Drawing Sheets

(56) References Cited

U.S. PATENT DOCUMENTS 7,770,337 B2 * 8/2010 Mower ..... E04H 1/1205 52/79.5
7,797,885 B2 * 9/2010 Mower ..... E04H 1/1205 52/270
7,926,227 B2 * 4/2011 Mower ..... E04B 1/34321 52/270
8,051,617 B2 * 11/2011 Mower ..... E06B 5/02 52/311.1
8,707,631 B2 * 4/2014 Scouten ..... E04H 9/14 52/68
10,422,169 B2 * 9/2019 Christenson ..... E05D 1/02
10,697,171 B2 * 6/2020 Melo Pereira ..... E04C 2/384
11,020,681 B2 * 6/2021 Rieber ..... F16C 11/04
11,066,994 B2 * 7/2021 Porte ..... F02C 7/045
11,135,525 B2 * 10/2021 Rieber ..... E04B 1/3445
11,274,431 B2 * 3/2022 McCall ..... E04F 13/0871
11,846,130 B2 * 12/2023 Jiang ..... E05D 1/02
11,927,008 B2 * 3/2024 Giacomini ..... E04B 1/345
12,116,773 B2 * 10/2024 Keller ..... E04C 2/46
12,291,859 B2 * 5/2025 Keller ..... E04B 5/02
12,480,303 B2 * 11/2025 Jiang ..... E04B 1/34317
12,486,659 B2 * 12/2025 Jiang ..... E04B 1/34317
12,560,011 B2 * 2/2026 Jiang ..... E05D 1/02
12,584,313 B2 * 3/2026 Weng ..... E04C 2/40
2003/0005660 A1 * 1/2003 Stibolt ..... E04F 13/06 52/582.1
2005/0126083 A1 * 6/2005 Rebeck ..... E04H 1/1205 52/79.1
2005/0210760 A1 * 9/2005 Mower ..... E06B 5/02 52/64
2005/0223652 A1 * 10/2005 Mower ..... E04B 1/34321 52/79.1
2005/0223653 A1 * 10/2005 Mower ..... E04H 1/1205 52/79.1
2005/0223655 A1 * 10/2005 Mower ..... E04H 1/1205 52/79.5
2007/0199176 A1 * 8/2007 Mc Clellan ..... E05D 1/02 16/224
2007/0267155 A1 * 11/2007 Howe ..... E06B 3/481 160/232
2008/0216426 A1 * 9/2008 Bunker ..... E04B 1/34315 52/285.3
2011/0011010 A1 * 1/2011 Mower ..... E04B 7/20 52/79.5
2012/0180404 A1 * 7/2012 Scouten ..... E04H 9/028 52/79.5
2015/0067983 A1 * 3/2015 Carey ..... B29C 48/0017 16/225
2016/0138258 A1 * 5/2016 Schaffert ..... E04B 1/3445 52/79.5
2017/0051497 A1 * 2/2017 Kolbe ..... E04H 1/1205
2018/0283065 A1 * 10/2018 Christenson ..... B32B 5/24
2019/0055728 A1 * 2/2019 Melo Pereira ..... E04C 2/22
2019/0136506 A1 * 5/2019 McCall ..... E04C 2/365
2020/0049462 A1 * 2/2020 Jones ..... E04H 1/1205
2020/0102890 A1 * 4/2020 Porte ..... F02C 7/045
2020/0215448 A1 * 7/2020 Rieber ..... A63H 33/008
2020/0215449 A1 * 7/2020 Rieber ..... E04B 1/345
2022/0127840 A1 * 4/2022 Giacomini ..... E04B 1/34384
2022/0298783 A1 * 9/2022 Shi ..... E04B 1/3445
2023/0061113 A1 * 3/2023 Keller ..... E04B 2/56
2023/0068992 A1 * 3/2023 Streeter ..... E04H 1/005
2023/0120248 A1 * 4/2023 Jiang ..... E05D 1/02 16/254
2023/0167636 A1 * 6/2023 Keller ..... E04B 1/14 52/91.3
2024/0035271 A1 * 2/2024 Jiang ..... E04B 1/34317
2024/0035272 A1 * 2/2024 Jiang ..... E04B 1/34317
2024/0068285 A1 * 2/2024 Jiang ..... E05D 1/02
2025/0027314 A1 * 1/2025 Lin ..... E04H 1/1205
2025/0034891 A1 * 1/2025 Jiang ..... E04H 1/1205
2025/0163695 A1 * 5/2025 Rais-Rohani ..... E04B 1/3445
2025/0188740 A1 * 6/2025 Weng ..... E04C 2/40
2025/0333960 A1 * 10/2025 Jiang ..... E04H 1/1205
2025/0333988 A1 * 10/2025 Jiang ..... E05D 3/02
2026/0055596 A1 * 2/2026 Jiang ..... E04B 1/34317
2026/0055597 A1 * 2/2026 Jiang ..... E04B 1/34317
2026/0062973 A1 * 3/2026 Procton ..... E05D 15/48

* cited by examiner

OPTIMIZED WALL STRUCTURE OF A PREFAB MODULAR SHED

CROSS-REFERENCES TO RELATED APPLICATIONS

This application claims the priority of Chinese Application No. 202420876192.1, entitled "Wall Structure of a Modular Shed," filed Apr. 25, 2024, which is incorporated herein by reference for all purposes.

TECHNICAL FIELD

The present subject matter is in the field of plastic assembly. More particularly, embodiments of the present subject matter relate to a storage shed comprising modular molded plastic panels.

BACKGROUND

Molded plastic has a wide variety of benefits as a furniture material and component. For example, it is highly resistant to impact, moisture, and chemicals, which makes it more durable compared to other materials like wood or glass; it is also lighter than many other materials, rendering it advantageous for transportation cost. Furthermore, molded plastics can be shaped into virtually any form, allowing for a great deal of design flexibility. This allows for more creative and complex designs than other materials. An example of such a design is a prefab modular shed that is economical to manufacture, easy to transport and install while providing many novel and beneficial design features.

The shed's wall is an important component because its stability has a significant impact on the overall structural stability. For traditional wooden sheds, the wall panels are typically put together using numerous screws. Although this provides a strong shed, it increases manufacturing costs and assembly complexity. For metal sheds, the wall structure also requires screws or bolts to assemble, which is also difficult to install.

Existing plastic sheds often suffer from insufficient structural strength. For example, the conventional wall panels are assembled by slotting them between the roof and base panels, which have the drawback of insufficient structural strength or support. In summary, there is a need for further improvement in the wall structures of plastic modular sheds.

SUMMARY OF THE INVENTION

The present subject matter is directed to improved designs for the wall assembly of a plastic modular shed with optimized structure stability and yet is convenient to assemble and dissemble using prefabbed plastic components. Embodiments of the present subject matter are discussed below with reference to FIGS. 1-8.

In the following description, for purposes of explanation, numerous specific details are set forth in order to provide a thorough understanding of the present subject matter. It will be apparent, however, to one skilled in the art that the present subject matter may be practiced without some of these specific details. In addition, the following description provides examples, and the accompanying drawings show various examples for the purposes of illustration. Moreover, these examples should not be construed in a limiting sense as they are merely intended to provide examples of embodiments of the subject matter rather than to provide an exhaustive list of all possible implementations. In other instances, well-known structures and devices are shown in block diagram form in order to avoid obscuring the details of the disclosed features of various described embodiments.

The present subject matter is directed to an improved wall structure for a modular plastic shed, designed for easy on-site assembly using pre-constructed modular panels. The enhanced wall structure features T-shaped connection accessories that securely install the wall to the floor panels. Additionally, support columns with integrated reinforcement ribs are incorporated to further strengthen the overall structure. These support columns also feature pre-formed sockets, allowing for quick and straightforward attachment of the wall panels, simplifying the assembly process and improving structural integrity.

According to some embodiments, the present subject matter is directed to a wall assembly of a blow-molded modular shed that comprises: a plurality of wall panels connected to form side walls of the wall assembly, a plurality of floor panels connected to form a floor of the wall assembly, one or more T-shaped connectors configured to engage the plurality of wall panels with the plurality of floor panels, wherein each T-shaped connector has a mounting hole, and a plurality of support columns positioned at corners of the wall assembly, wherein each of the plurality of support columns has an outer support plate and an inner support plate that are joined by a plurality of reinforcing ribs between them.

According to some embodiments, the present subject matter is directed to a wall assembly of a blow-molded modular shed that comprises: a plurality of wall panels connected to form side walls of the wall assembly, a plurality of floor panels connected to form a floor of the wall assembly, one or more T-shaped connectors configured to engage the plurality of wall panels with the plurality of floor panels, wherein each T-shaped connector has a mounting hole, and a plurality of support columns positioned at corners of the wall assembly, wherein each of the plurality of support columns has an outer support plate and an inner support plate that are joined by a plurality of reinforcing ribs between them, and wherein the plurality columns further connect with corner wall panels via pre-formed socket openings.

According to some embodiments, the present subject matter is directed to a modular shed structure made of molded plastic panels that comprises: a plurality of door panels, a roof, a plurality of wall panels connected to form side walls of the wall assembly, a plurality of floor panels connected to form a floor of the wall assembly, one or more T-shaped connectors configured to engage the plurality of wall panels with the plurality of floor panels, wherein each T-shaped connector has a mounting hole, and a plurality of support columns positioned at corners of the wall assembly, wherein each of the plurality of support columns has an outer support plate and an inner support plate that are joined by a plurality of reinforcing ribs between them.

According to some embodiments, the wall assembly further comprises a plurality of fixation elements to pass through the mounting holes of the one or more T-shaped connectors, wherein the plurality of fixations elements comprise one or more of screws or rivets.

According to some embodiments, the plurality of wall panels are connected to form side walls of the wall assembly via a first coupling structure comprising one or more screws, or one more snaping portions along the sides of the panels.

According to some embodiments, the peripheral sides of the plurality of floor panels have upward-opening strip grooves configured to receive the one or more T-shaped connectors. Furthermore, the plurality of wall panels and the plurality of floor panels can further jointly form one or more T-shaped installation holes for receiving the one or more T-shaped connectors. The one or more T-shaped installation holes are further partially formed by pre-formed notches at the bottom side of the wall panels.

According to some embodiments, the plurality of support columns further comprise socket openings configured to receive wall panels via their recess areas. Furthermore, at least one of the outer support plate and the inner support plate of the support column provides an extension section to be engaged with the wall panel. According to some embodiments, the plurality of support columns are formed by an injection molding process.

According to some embodiments, to fix the wall panels to the floor, a floor panel, on the edge, can have an upward-opening strip groove. Inside the grooves, there can be T-shaped installation holes spaced along the length of the grooves. The wall panels can be inserted into the slot from top to bottom and secured using specially designed T-shaped connectors and additional screws. The vertical portion of the T-shaped connector can pass through the T-shaped installation hole and extend above the slot, where it can be fixed to the wall panels with screws. The horizontal portion of the T-shaped connector can be positioned at the bottom of the T-shaped installation hole to increase the connection between the wall and floor panels.

To render the connection between the wall panels and the floor more secure, the lower part of the wall panels has a notch, and the vertical portion of the T-shaped connector extends into the notch and rests against the inner sidewall of the wall panel.

To connect and secure the wall panels on adjacent sides, the shed structure can include support columns that connect the wall panels on adjacent sides. The support columns consist of an outer support plate and an inner support plate connected by reinforcing ribs between them. Between these plates can locate a socket opening towards the corresponding side wall panel, into which the wall panels are inserted. In addition, the flat wall panels can adopt a support column between the adjacent planar wall panels.

According to some embodiments, a wall panel can comprise embedded folding groove with thinner plastic material. The embedded folding groove can enable the wall panel to be folded and form a seamless corner when the storage shed structure is installed.

According to some embodiments, the modular shed structure can further comprise a door lintel installed between the roof and the one or more door panels, wherein the door lintel can comprise a upper edge to engage with a downward-facing slot on the roof. The door lintel further can further comprise a position bump formed on top of the triangular door lintel, and the position bump can be embedded into a position recess formed on the roof.

According to some embodiments, the modular shed structure can further comprise one or more door panels that is integrally formed with embedded folding grooves. The door panels can be coupled to the wall panels via screws, snapping portions or other connection methods.

Compared to conventional designs, the advantages of the present subject matter include: the structure stability between two perpendicular panels, such as the wall panels and the floor, are enhanced through the T-shaped connectors. The T-shaped connectors can provide additional contact surface and connection force via screws. The adoption of the T-shaped connectors also reduces the need of a large number of screws or other fixation elements, which are time consuming and labor intensive to handle. Furthermore, the corners of the wall panels are further reinforced by support columns with reinforcement ribs. Such support columns can further provide socket opening to receive and secure the wall panels, leading to simple assembly and disassembly of the modular shed.

Other aspects and advantages of the present subject matter will become apparent from the following detailed description taken in conjunction with the accompanying drawings, which illustrate, by way of example, the principles of the present subject matter.

DESCRIPTION OF DRAWINGS

The present subject matter will be further described in detail below with reference to the embodiments of the accompanying drawings.

DETAILED DESCRIPTION

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

Figure 1:
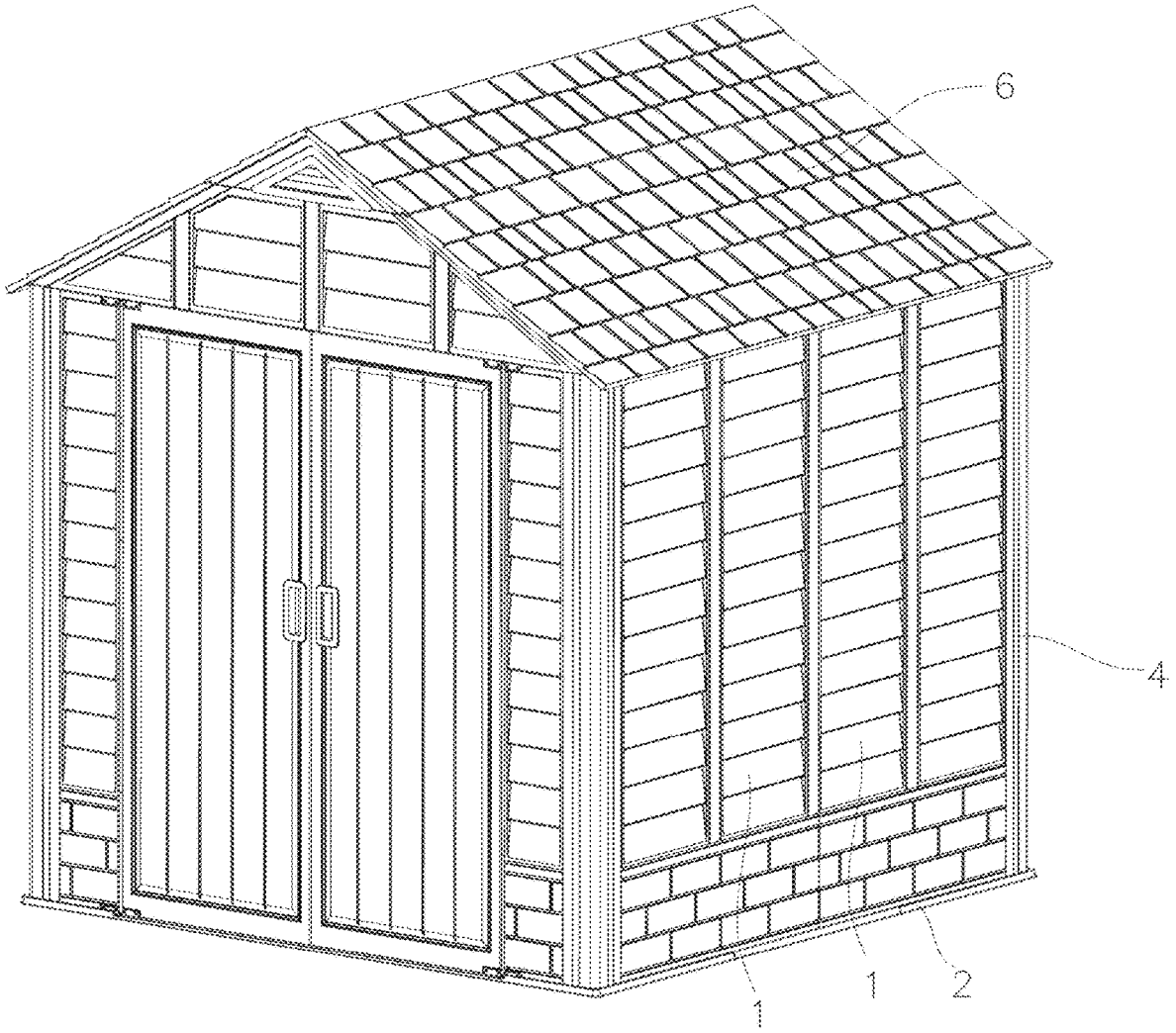
FIG. 1 is a schematic structural diagram of a prefab modular shed structure, according to one embodiment of the present subject matter.
Figure 2:
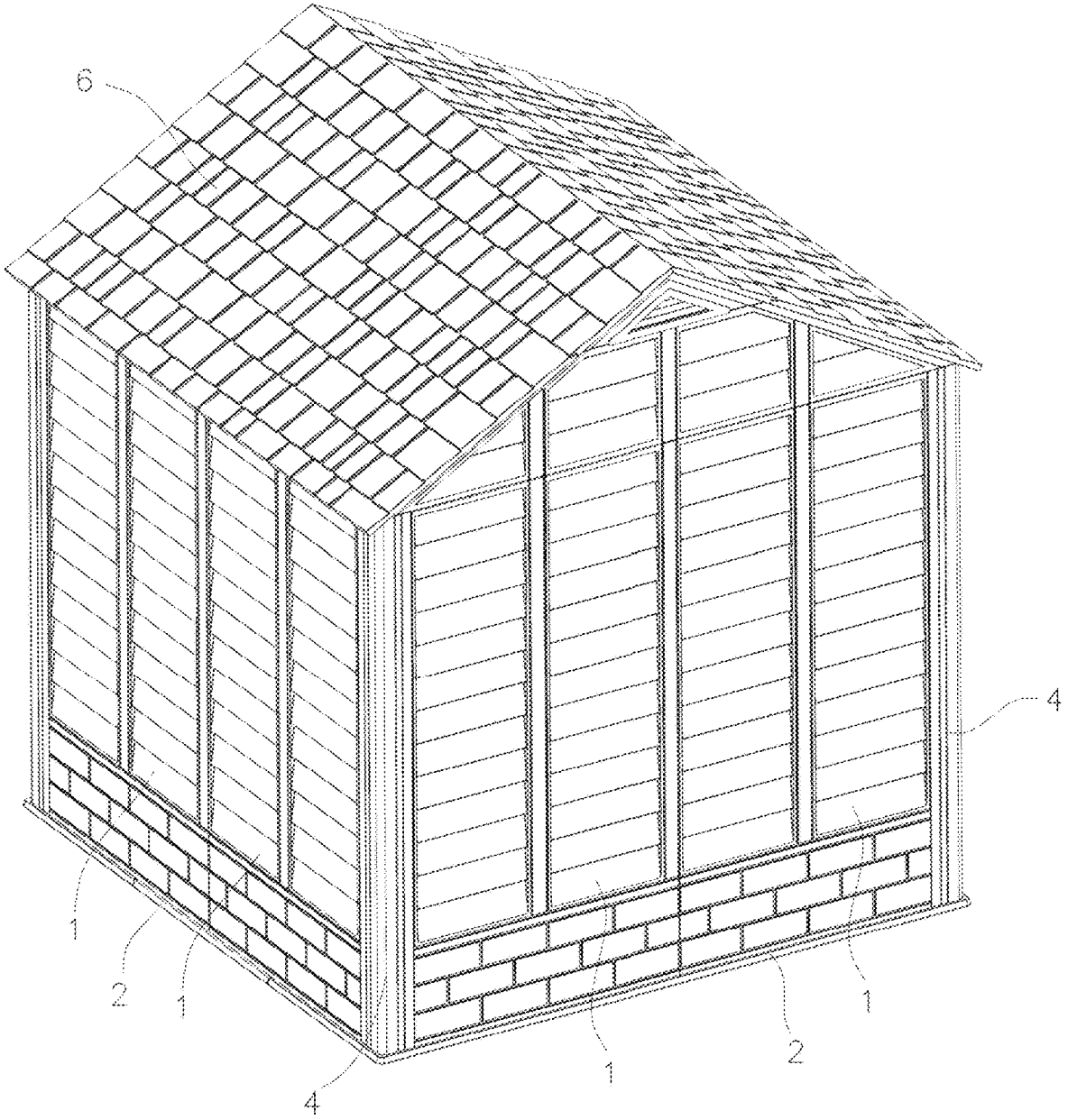
FIG. 2 is a schematic structural diagram of the prefab modular shed structure from another angle as shown in FIG. 1.

According to some embodiments, FIGS. 1 and 2 are schematic structural diagrams of a prefab modular shed structure. A prefab modular shed structure can include a floor 2, wall panels 1, support columns 4 and a roof 6. The floor 2, wall panels 1 and roof 6 can be made of blow-molded panels and assembled on site with a modular overlapping method. The support columns 4 can be made of injection molding plastic for extra support. The bottom of the wall panels 1 can be detachably connected to the floor 2. According to one embodiment, a door lintel can be detachably installed on the wall panels and door panels. The roof 6 can be detachably installed on the roof's beam support frames.

Figure 3:
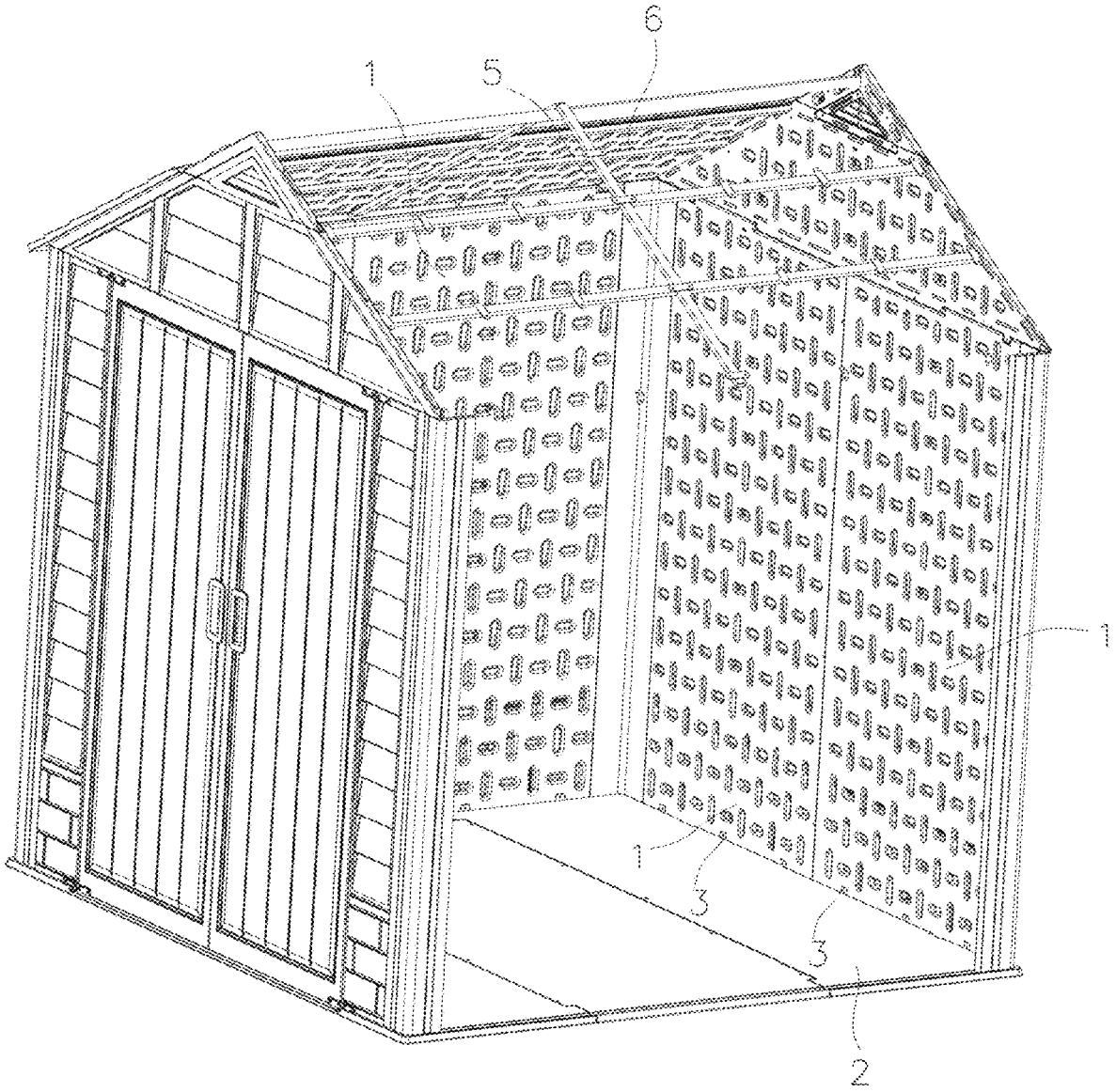
FIG. 3 is a schematic structural diagram of the prefab modular shed shown in FIG. 2 with part of the roof and some wall panels revealed.
Figure 4:
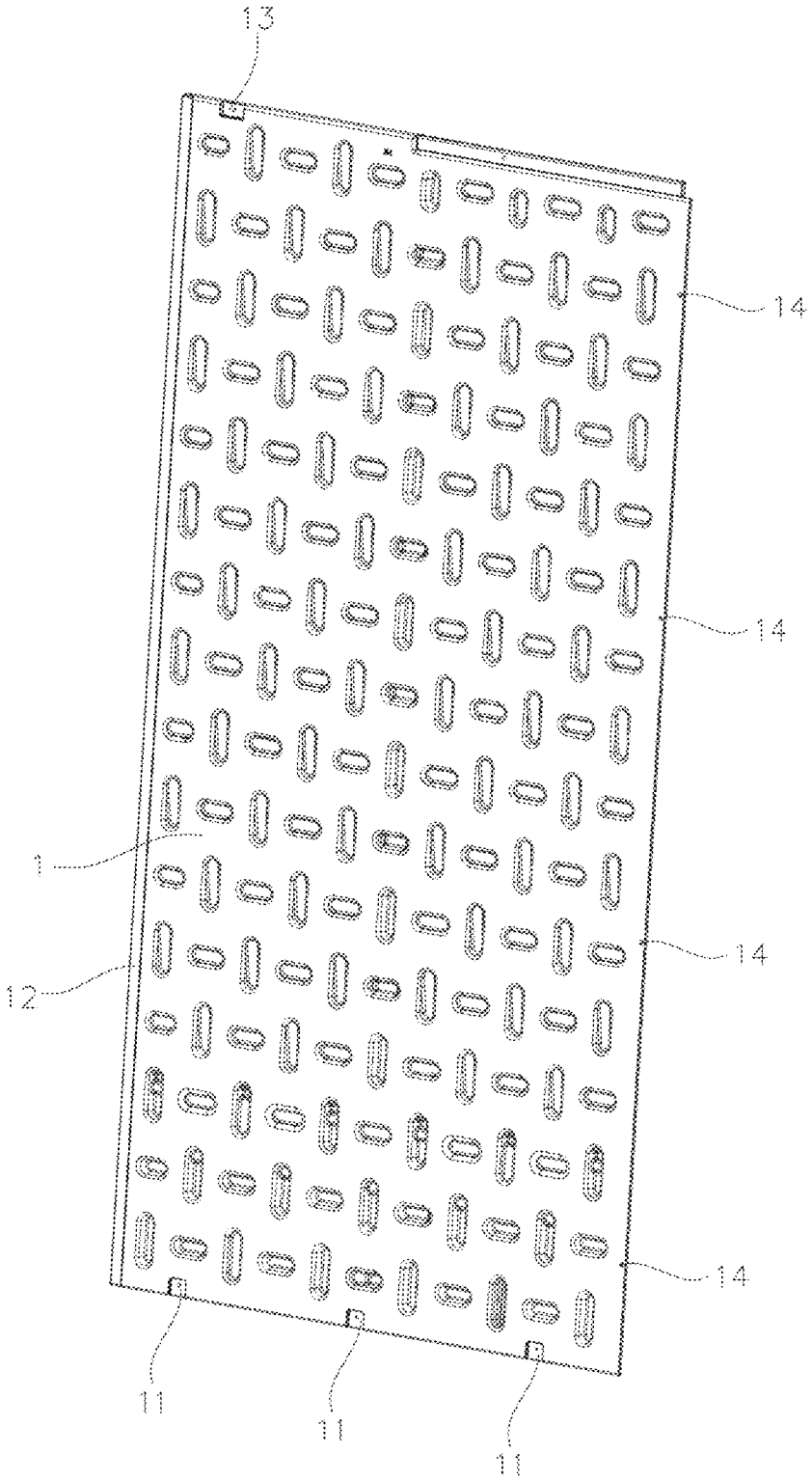
FIG. 4 is a schematic structural diagram of the wall panel, according to one embodiment of the present subject matter.

According to some embodiments, as shown in FIGS. 3-7, the wall panels 1 and floor 2 can be assembled with the assistance of a specific connector, T-shaped connector 3, designed to secure the connections within these components. According to some embodiments, as shown in FIGS. 3 and 4, the upper edge of the wall panel 1 can have an upper notch 13, and a connecting plate 5 can be installed in this notch 13. As such, the wall panel 1 can be fixed to the shed's roof 6 through the connecting plate 5.

According to some embodiments, FIG. 4 is an exemplary wall panel 1 of a prefab modular shed. Wall panel 1 can have recess area 12 on one side to insert into a socket opening of the support column. The upper edge of the wall panel 1 can pre-form an upper notch 13 for connecting the panel with the roof via the connector 5. The lower edge of the wall panel 1 can pre-form a notch 11 for connecting with the floor 2 via the T-shaped connector 3.

According to some embodiments, a side wall can comprise two or more wall panels 1. The joint area between adjacent wall panels 1 can have corresponding screw holes 14. Self-tapping screws can pass through these screw holes (14) to connect and fix the adjacent wall panels 1. Additional coupling mechanisms, such as embedded snap couplings, can also be adopted between these wall panels.

Figure 5:
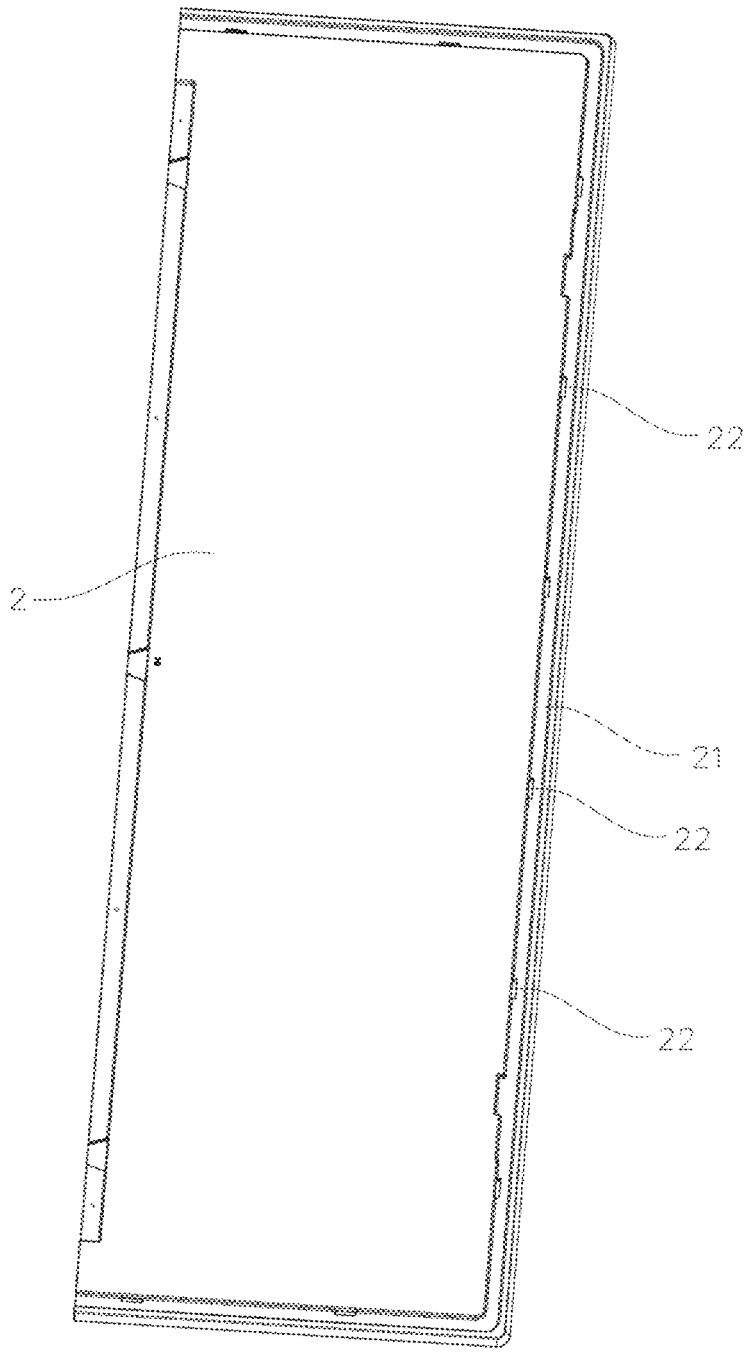
FIG. 5 is a schematic structural diagram of the floor, according to one embodiment of the present subject matter.

According to some embodiments, FIG. 5 is an exemplary floor panel 2 of a prefab modular shed. The edge of the floor panel 2 can have an upward-facing strip groove 21. Inside the slot 21, along its length, there can be pre-formed as partial of T-shaped mounting holes 22. The wall panel 1 can be inserted into the upward-facing strip groove 21. Furthermore, a notch 11 (see FIG. 4) molded at the lower part of the inner side of the wall panel 1 can be partial of T-shaped mounting holes 22, which can receive the vertical portion 31 of the T-shaped connector 3.

Figure 6:
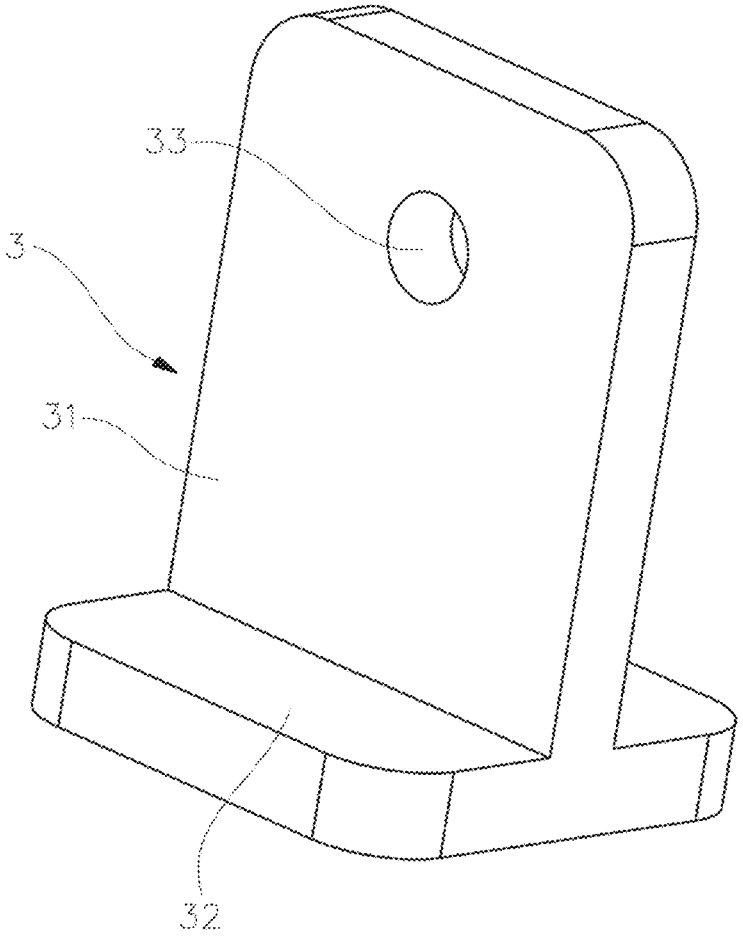
FIG. 6 is a schematic structural diagram of a T-shaped connector, according to one embodiment of the present subject matter.
Figure 7:
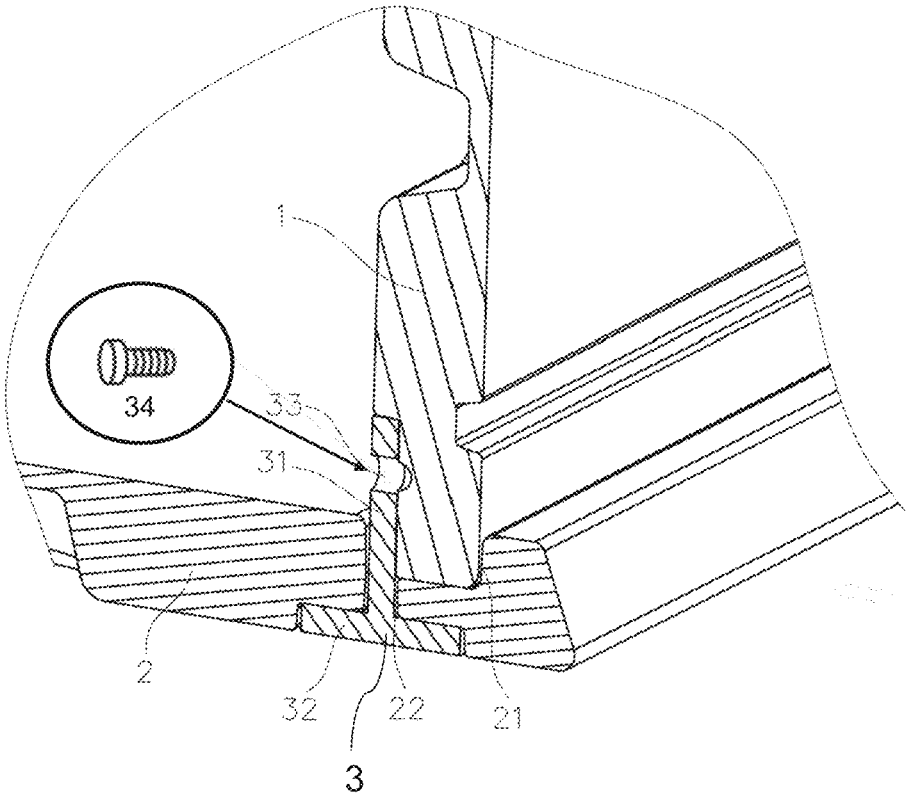
FIG. 7 is a schematic structural diagram of the assembly structure of the wall panel and floor, according to one embodiment of the present subject matter.

As shown in FIGS. 6 and 7, the specific connector for coupling the wall panels 1 and the floor 2 can comprise a T-shaped connector 3 that corresponds to the T-shaped mounting hole 22. The vertical portion 31 of each T-shaped connector 3 can pass upward through the T-shaped mounting hole 22 and extend above the strip groove 21. The vertical portion 31 of the T-shaped connector 3 can protrude above the strip groove 21 and can be fixed to the wall panel 1, for example, via a pre-formed notch 11 embedded in the wall panel 1 and a screw 34.

According to some embodiments, the horizontal portion 32 of the T-shaped connector 3 can engage with the bottom of the T-shaped mounting hole 22. According to some embodiments, as shown in FIG. 4, the lower part of the inner side wall of the wall panel 1 can be equipped with a number of pre-formed notches 11. The vertical portion 31 of the T-shaped connector 3 can rest into the notch 11 and can abut against the inner side wall of the wall panel 1.

According to some embodiments, a mounting hole 33 can be pre-formed in the protruding part of the vertical portion 31. A fixation component, such as a screw 34, can connect and secure the wall panel 1 via the mounting hole 33. For example, the screw can be a self-tapping screw, or a spike. In another example, a rivet can be used. According to some embodiments, a second mounting hole on the vertical portion 31 can be formed, which can receive another screw to connect the wall panel and floor. Additionally, after installing the T-shaped connectors 3, the lower surface of the horizontal portion 32 of the T-shaped connector 3 can be flush with the lower surface of the surrounding area of the strip groove 21 of the floor 2.

As such, with additional contact surfaces and fixation elements, the T-shaped connector 3 can securely lock the wall panel 1 with the floor 2 to ensure that the wall panel does not shift under external force, providing a secure assembly structure. According to some embodiments, the T-shaped connector 3 can be adopted to connect any adjacent and perpendicular panels of the modular shed.

Figure 8:
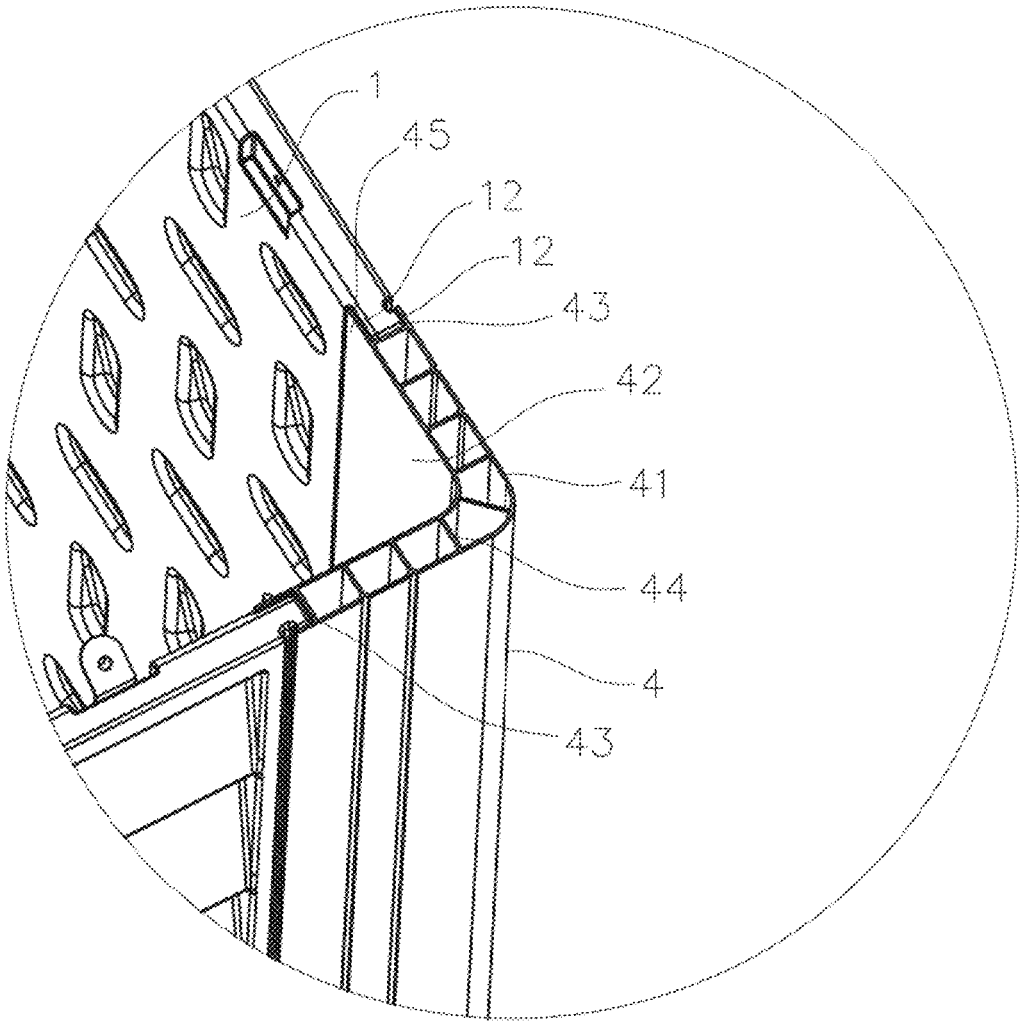
FIG. 8 is a schematic structural diagram of a support column of adjacent wall panels, according to one embodiment of the present subject matter.

According to some embodiments, as shown in FIG. 8, the corner connection between adjacent wall panels 1 of the shed structure can be achieved through support columns 4. The support columns 4 can be formed via injection mold and can feature reinforcing ribs vertically arranged. These support columns can have an outer support plate 41 and an inner support plate 42. To enhance the structural strength of the support columns, reinforcing 44 can connect the outer and inner support plates, preventing deformation due to compression.

According to some embodiments, an opening facing the corresponding side wall panel 1 can form a socket 43 formed between the outer and inner support plates. The wall panels 1 can be inserted into the corresponding sockets 43 with a corresponding and tight fit. Additionally, the edges of the inner support plates 42 can extend further than those of the outer support plates 41, forming an extension section 45 that can be fixed to the wall panels 1 with screws, which can be self-tapping screws. According to some embodiments, a flat support column, instead of being a corner component, can serve as a support column and connector between adjacent wall panels 1.

According to some embodiments, the storage shed structure of the present subject matter can be an indoor shed. Furthermore, some or all features of the present subject matter can be incorporated into other types of molded plastic assembly.

The above are only the preferred embodiments of the present subject matter. It should be pointed out that for those of ordinary skill in the art, without departing from the principle of the present subject matter, various modifications or improvements can be made to the present subject matter, such as in other applications. For example, the disclosed features can be incorporated into other molded plastic furniture assemblies, or these features, when applicable, can be incorporated into non-molded plastic furniture assembly, and these are all considered to be within the protection scope of the present subject matter.

It is to be understood that even though numerous characteristics and advantages of various embodiments of the present subject matter have been set forth in the foregoing description, together with details of the structure and function of various embodiments of the subject matter, this disclosure is illustrative only. In some cases, certain subassemblies are only described in detail with one such embodiment. Nevertheless, it is recognized and intended that such subassemblies may be used in other embodiments of the subject matter. Practitioners skilled in the art will recognize many modifications and variations. Changes may be made in detail, especially matters of structure and management of parts within the principles of the embodiments of the present subject matter to the full extent indicated by the broad general meaning of the terms in which the appended claims are expressed.

Having disclosed exemplary embodiments and the best mode, modifications and variations may be made to the disclosed embodiments while remaining within the scope of the embodiments of the subject matter as defined by the following claims.

What is claimed is:

1. A wall assembly of a blow-molded modular shed, comprising:

a plurality of wall panels connected to form side walls of the wall assembly;

a plurality of floor panels connected to form a floor of the wall assembly, at least one said floor panel having an upward-opening strip groove extending along a peripheral edge thereof;

one or more T-shaped connectors configured to engage the plurality of wall panels with the plurality of floor panels, wherein each T-shaped connector has a mounting hole; and a plurality of support columns positioned at corners of the wall assembly, wherein each of the plurality of support columns has an outer support plate and an inner support plate that are joined by a plurality of reinforcing ribs therebetween;

wherein engaged ones of the wall panels and the floor panels jointly define T-shaped installation holes on respective peripheral edges thereof configured to receive the T-shaped connectors.

2. The wall assembly of claim 1, further comprising:

a plurality of fixation elements to pass through the mounting holes of the one or more T-shaped connectors, wherein the plurality of fixations elements comprise one or more of screws or rivets.

3. The wall assembly of claim 1, wherein the plurality of wall panels are connected to form the side walls of the wall assembly via a first coupling structure comprising one or more screws.

4. The wall assembly of claim 1, wherein the plurality of wall panels are connected to form the side walls of the wall assembly via a first coupling structure comprising one or more snapping portions along sides of the plurality of wall panels.

5. The wall assembly of claim 1, wherein the peripheral edges of the plurality of floor panels each have the upward-opening strip grooves configured to receive the one or more T-shaped connectors.

6. The wall assembly of claim 1, wherein the plurality of support columns further comprise socket openings configured to receive the wall panels via respective recess areas.

7. The wall assembly of claim 6, wherein at least one of the outer support plate and the inner support plate of the support columns provides an extension section to be engaged with the wall panels.

8. The wall assembly of claim 6, wherein the plurality of support columns are formed by an injection molding process.

9. A wall assembly of a blow-molded modular shed, comprising:

a plurality of wall panels connected to form side walls of the wall assembly;

a plurality of floor panels connected to form a floor of the wall assembly, at least one said floor panel having an upward-opening strip groove extending along a peripheral edge thereof;

one or more T-shaped connectors configured to engage the plurality of wall panels with the plurality of floor panels, wherein each T-shaped connector has a mounting hole; and a plurality of support columns positioned at corners of the wall assembly, wherein each of the plurality of support columns has an outer support plate and an inner support plate that are joined by a plurality of reinforcing ribs therebetween between, and wherein the plurality columns further connect the corners to the wall panels via pre-formed socket openings;

wherein engaged ones of the wall panels and the floor panels jointly define T-shaped installation holes on respective peripheral edges thereof configured to receive the T-shaped connectors.

10. The wall assembly of claim 9, further comprising:

a plurality of fixation elements to pass through the mounting holes of the one or more T-shaped connectors, wherein the plurality of fixations elements comprise one or more of screws or rivets.

11. The wall assembly of claim 9, wherein the peripheral edges of the plurality of floor panels each have the upward-opening strip grooves configured to receive the one or more T-shaped connectors.

12. The wall assembly of claim 9, wherein a lower part of the plurality of wall panels have pre-formed notches to receive the one or more T-shaped connectors.

13. A modular shed structure made of molded plastic panels, comprising:

a plurality of door panels;

a roof;

a plurality of wall panels connected to form side walls of the wall assembly;

a plurality of floor panels connected to form a floor of the wall assembly, at least one said floor panel having an upward-opening strip groove extending along a peripheral edge thereof;

one or more T-shaped connectors configured to engage the plurality of wall panels with the plurality of floor panels, wherein each T-shaped connector has a mounting hole; and a plurality of support columns positioned at corners of the wall assembly, wherein each of the plurality of support columns has an outer support plate and an inner support plate that are joined by a plurality of reinforcing ribs therebetween;

wherein engaged ones of the wall panels and the floor panels jointly define T-shaped installation holes on respective peripheral edges thereof configured to receive the T-shaped connectors.

14. The modular shed structure of claim 13, further comprising:

a plurality of fixation elements to pass through the mounting holes of the one or more T-shaped connectors, wherein the plurality of fixations elements comprise one or more of screws or rivets.

15. The modular shed structure of claim 13, wherein the plurality of wall panels are connected to the form side walls of the wall assembly via a first coupling structure comprising one or more screws.

16. The modular shed structure of claim 13, wherein the peripheral edges of the plurality of floor panels each have the upward-opening strip grooves configured to receive the one or more T-shaped connectors.

17. The modular shed structure of claim 13, wherein the plurality of support columns further comprise socket openings configured to receive the wall panels via respective recess areas.

* * * * *